US006385431B1

(12) United States Patent
Arcaro et al.

(10) Patent No.: US 6,385,431 B1
(45) Date of Patent: May 7, 2002

(54) PRINT MEDIA SHEET FEEDER AND PRINTING SYSTEM

(75) Inventors: David J. Arcaro, Boise; Wayne E. Foote, Eagle, both of ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/779,008

(22) Filed: Feb. 6, 2001

(51) Int. Cl.[7] ..... G03G 15/00
(52) U.S. Cl. ..... 399/381; 271/278; 399/401
(58) Field of Search ..... 399/381, 401, 399/388, 397; 346/134; 347/104, 153; 198/688.1; 271/3.21, 248, 275, 278; 400/634, 635, 636

(56) References Cited

U.S. PATENT DOCUMENTS

| | | | | |
|---|---|---|---|---|
| 5,212,532 A | * | 5/1993 | Storlie | 399/167 |
| 5,931,457 A | * | 8/1999 | Todoki | 271/275 X |
| 5,978,642 A | | 11/1999 | Arcaro et al. | 399/381 |
| 6,118,465 A | | 9/2000 | Arcaro et al. | 347/153 |

* cited by examiner

*Primary Examiner*—Joan Pendegrass

(57) ABSTRACT

A print media sheet feeder system includes an edge guide grit belt to guide and move a sheet of media along a travel path of a peripheral device, and at least one pinch roller provided for co-rotation with the grit belt, wherein the sheet of media is moved between the belt and the roller along one edge.

20 Claims, 2 Drawing Sheets

PRINT MEDIA SHEET FEEDER AND PRINTING SYSTEM

FIELD OF THE INVENTION

This invention pertains to drive systems for delivering media during a printing process. More particularly, this invention relates to precise transport and registration of print media during a printing process such as when printing one or more image planes onto a sheet of paper with a color laser printing system.

BACKGROUND OF THE INVENTION

Color image printing systems are known in the art. One color image printing system comprises a color laser, or electrophotographic, printer. Color laser printers generate sufficient text and graphics quality for most business applications. However, color laser printers typically require complex and expensive mechanisms when forming and aligning overlaid color frames. Hence, color laser printers are not sufficiently economical for many applications.

One problem encountered with color laser printers relates to registration of individual color image planes that generate a printed color page. Typically, three or four distinct color image planes are somehow imaged and transferred onto a common piece of paper in order to generate a color image. In some cases, a yellow, a magenta and a cyan color image plane are each imaged and transferred onto a common piece of paper. In other cases, a black, a yellow, a magenta and a cyan color image plane are each imaged and transferred. Irrespective of whether individual color image planes are serially or concurrently transferred onto a piece of paper, registration of individual color image planes is very important, and even slight variations between image planes can cause hue and density shifts throughout a printed page.

One type of color image printing system builds up four different colored image planes onto a well-controlled substrate before transferring the generated image onto a piece of paper. One exemplary printing system comprises a Hewlett-Packard Color LaserJet 5, manufactured by Hewlett-Packard Co. of Palo Alto, Calif. Such exemplary printing system builds up a color image onto a page size photoconductor drum. The generated image comprises four distinct colors: yellow, magenta, cyan and black. Four developers are used to produce the four colors, with four distinct photoconductor drum rotations being needed to accumulate the four-color toner images. Such printing system delivers four colors onto a photoconductor drum which are transferred in one step onto a sheet of paper. This results in a relatively low cost technique for achieving a four pass color laser printer having excellent plane-to-plane registration.

Another type of color image printing system builds up an image on a page size intermediate transfer medium. One example a Tektronix Phaser 560, manufactured by Tektronix of Wilsonville, Oreg. However, this system uses an intermediate transfer medium which increases cost and complexity. Yet another type of color image printing system comprises a Xerox C55 color laser printer. Such laser printer fixes a sheet of paper onto a drum in order to achieve plane-to-plane registration of successively colored image planes. However, this system adds considerable size and complexity to a color laser printer.

Recent attempts have been made to improve precise positioning of print media to enhance registration of image planes that are deposited atop the print media. U.S. Pat. No. 5,978,642 discloses a shuttle type paper drive for multiple pass color laser printing which uses a grit shaft and pinch rollers to accurately move the print media along a bidirectional travel path and register the print media and multiple image planes. However, such shuttle type paper drive requires a significant top or bottom margin because the grit shaft must maintain contact with the print media at a pinch zone. Accordingly, there exists a significant bottom margin area which cannot be used for color printing.

Each of the above-mentioned printing systems increases the size of the printer or increases the complexity or cost of the printer. Furthermore, the shuttle type paper drive in U.S. Pat. No. 5,978,642 requires excessive margin areas on the print media. Therefore, there exists a need to provide a reduced cost and complexity technique for more accurately transporting and registering image planes onto a print media. For example, there exists a need for improved accuracy of image plane registration and a need to minimize margin size so as to reduce paper waste when moving a sheet of paper about a travel path of a multiple pass color laser printer.

SUMMARY OF THE INVENTION

A recirculating type, or shuttle type, paper drive provides a relatively low cost technique for precisely moving and registering image planes for a multiple pass color laser printer. According to one implementation, a four pass color laser printer achieves improved precision registration for most types of printable paper.

According to one aspect, a print media sheet feeder system includes an edge guide grit belt to guide and move a sheet of media along a travel path of a peripheral device, and at least one pinch roller provided for co-rotation with the grit belt, wherein the sheet of media is moved between the belt and the roller along one edge.

According to another aspect, a printing system for printing at least one image plane onto a sheet of print media includes an electrophotographic print engine comprising a photoconductor drum and a transfer roller configured to interact in co-rotation with the drum during transfer of an image plane from the drum onto a sheet of print media passed therebetween, and a print media sheet feeder system includes an edge guide grit belt to guide and move a lateral edge of a sheet of media along a travel path of a peripheral device and a pinch roller provided for co-rotation with the belt, wherein the edge guide grit belt and the pinch roller cooperate to move the sheet of media along the travel path.

According to yet another aspect, a laser printer media drive system includes a drive motor, a drive wheel, a follower wheel, a grit belt, and a pinch roller. The drive wheel is driven by the drive motor. The follower wheel is disposed from the drive wheel. The grit belt is tensioned about the drive wheel and the follower wheel. The pinch roller is biased into engagement with the grit belt for co-rotation with the grit belt as a sheet of media is received therebetween. The drive motor and the drive wheel cooperate to move the grit belt along a lateral edge of a sheet of media to move the media along a travel path during a print operation.

One advantage is provided by precisely transferring a sheet of print media between successive passes against one or more photoconductor drums using an edge guide grit belt while transferring successive color image planes onto the sheet of print media so as to ensure precise registration between successive color image planes when forming an image.

Other features and advantages of the invention will become apparent to those of ordinary skill in the art upon review of the following detailed description, claims, and drawings.

DESCRIPTION OF THE DRAWINGS

Preferred embodiments of the invention are described below with reference to the following accompanying drawings depicting examples embodying the best mode for practicing the invention.

DETAILED DESCRIPTION OF THE INVENTION

Figure 1:
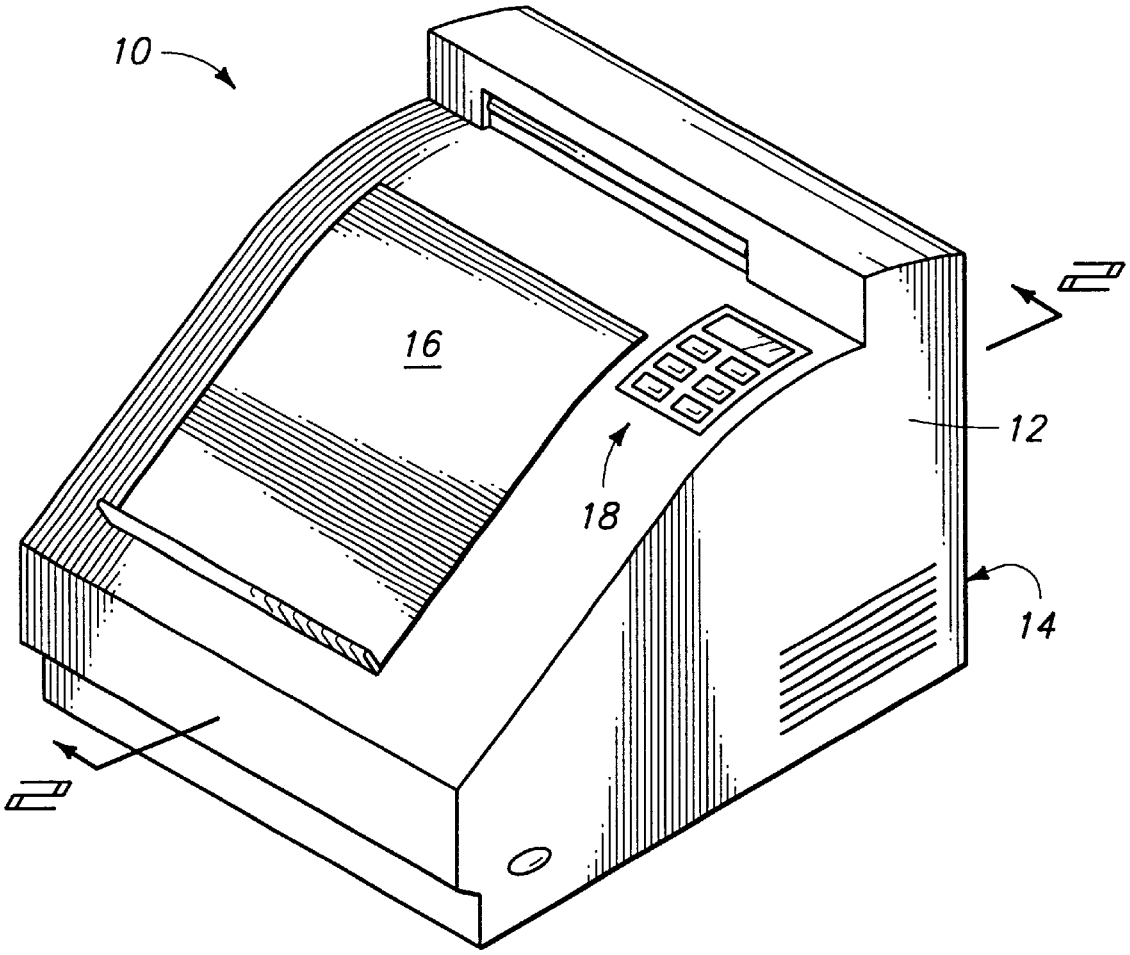
FIG. 1 is a perspective view of a printing system in accordance with one embodiment of Applicant's invention.

FIG. 1 shows a printing system 10 embodying Applicant's invention usable for printing color images onto a sheet or page of print media, such as a sheet of paper. Typically, printing system 10 is connected for control with a microprocessor-based computer (not shown). Printing system 10 comprises in electrophotographic printer configured to print monochrome and/or color images onto a sheet. As shown in FIG. 1, color laser printer 10 includes a housing 12, a paper tray 14, an output tray 16 and a user interface 16. User interface 18 includes one or more of a keyboard, a display, and a keypad that enables a user to operate and/or configure printer 10. Printer 10 is one example of a peripheral device.

As shown in FIG. 1, according to one implementation color laser printer 10 is configured to generate four different, successively transferred colored image planes. The image planes cooperate to form an image.

Alternatively, printer 10 can be configured to compose at least three different colored image planes. Even further alternatively, printer 10 can be configured to compose two different colored image planes. Optionally, such printer 10 can be used to generate a plurality of different or uniquely shaded image planes, each having a unique shade of a common color, such as two unique and distinguishable grey-scale image planes.

Irrespective of the total number of image planes, the ability to align such planes to one another is important to achieving precise color printing of a colored image. Furthermore, it is desirable to maximize the printable area on both sides of a sheet of paper. As used herein, the term "color printing" is understood to include the generation and transfer of a plurality of unique shades of a common color, or of different grey-scale image planes.

Figure 2:
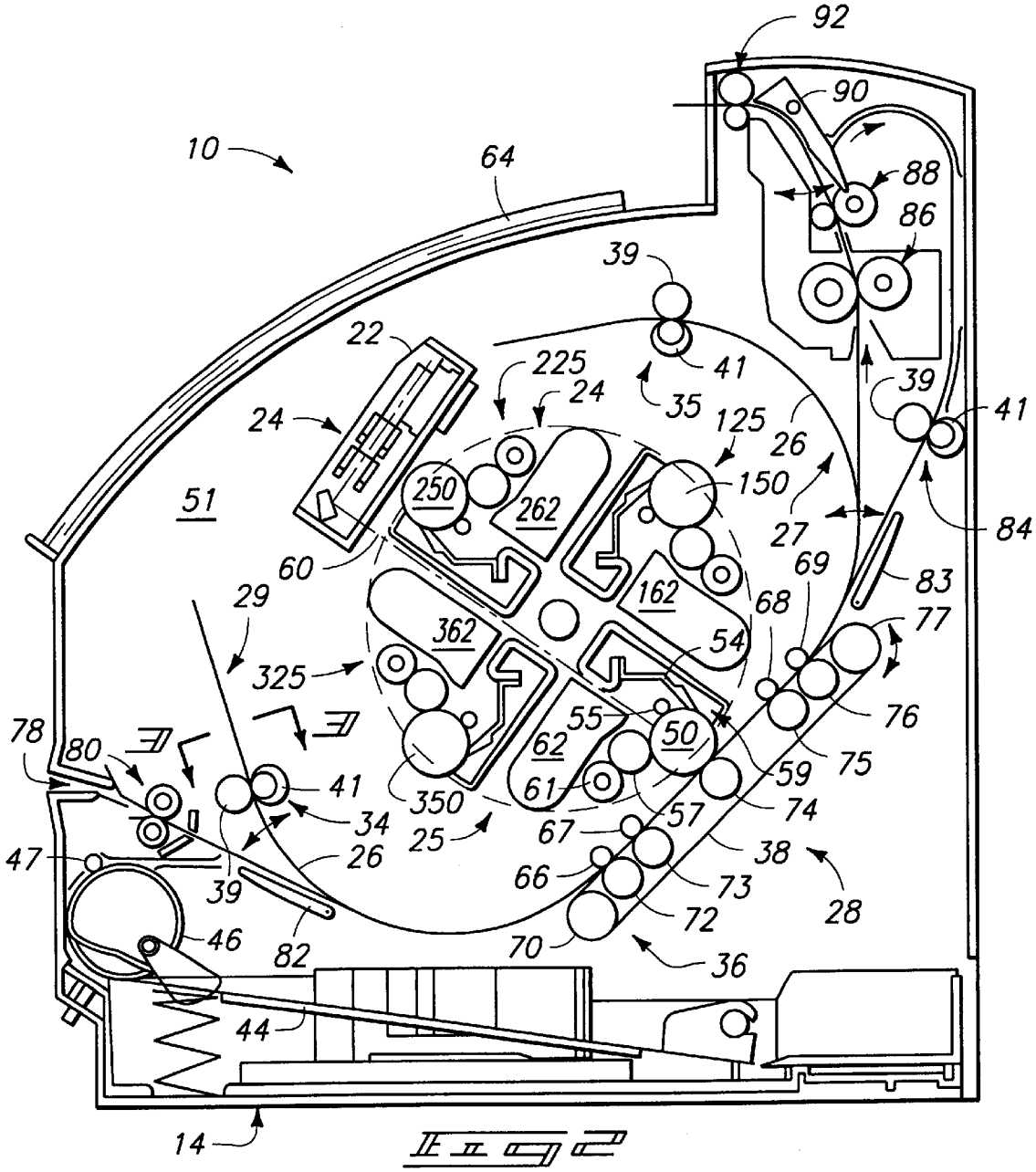
FIG. 2 is a vertical sectional view of the printing system of FIG. 1 taken along line 2—2.

FIG. 2 illustrates shuttle-type paper drive color laser printer 10 in vertical sectional view to enable description of internal operating components.

As shown in FIG. 2, a shuttle-type paper travel path 26 is depicted within printer 10, extending between a forward guide track 27 and a reverse guide track 29. A paper transport mechanism 28 accurately positions and moves a sheet of paper between forward guide track 27 and reverse guide track 29. More particularly, paper transport mechanism 28 comprises a grit belt transport assembly 36 that shuttles a sheet of paper between tracks 27 and 29 during transfer of individual image planes of a direct transfer multiple color image process. Additionally, paper transport mechanism 28 also includes a plurality of cone roller transport assemblies 34–35 that further guide a sheet of paper that is moved between forward and reverse directions via grit belt transport assembly 36. Roller transport assemblies 34–35 each include a spaced-apart pair of contacting rollers comprising a driven cylindrical roller 39 and a contacting cone roller 41. Roller 39 is driven by a drive motor and a belt drive such that coaction between rollers 39 and 41 imparts rotation to cone roller 41 as a sheet of paper is driven in forward and reverse directions using grit belt transport assembly 36.

Cylindrical roller 39 contains a central axis that extends perpendicular from a side wall of printer 10. Cone roller 41 is larger in diameter proximate such side wall and smaller in diameter towards the center of printer 10. Cone roller 41 comprises a hard plastic roller. Coaction of cone roller 41 with cylindrical driven roller 39 drives a sheet of paper therebetween so as to engage an edge of the sheet against the side wall of the printer so as to align the sheet there along (see FIG. 3). Such construction is analogous to a skew roller, presently understood in the art. However, such a cone roller can operate bi-directionally.

According to one construction, roller 39 comprises a paper drive roller, and roller 41 comprises an edge guide roller, or follower roller. Rollers 39 are coupled together for co-rotation via a gear train or a continuous belt drive. Alternatively, rollers 39 and 41 each comprise a freely rotating edge guide follower roller.

Details of one shuttle-type paper travel path are disclosed in Applicant's issued U.S. Pat. No. 5,978,642, herein incorporated by reference. Such shuttle-type paper travel path is similar to path 26, including forward and reverse guide tracks. However, printer 10 disclosed herein further includes a new and novel paper transport mechanism 28 comprising grit belt transport assembly 36.

Grit belt transport assembly 36 of paper transport mechanism 28 comprises an edge guide grit belt 38. According to one construction, grit belt 38 comprises a flat, continuous belt having an outer surface 40 that is coated with an abrasive grit. Optionally, belt 38 comprises a belt having a toothed inner surface and an outer surface that is coated with abrasive grit. According to such optional construction, belt 38 is received about toothed drive and follower wheels that inter-digitate with the toothed inner surface of the belt.

As shown in FIG. 2, shuttle-type paper travel path 26 extends about print engine 20, including laser scanner 22 and toner carousel 24. Paper transport mechanism 28 moves a sheet 64 of paper along shuttle-type paper travel path 26 to provide a shuttle-type paper drive for a direct transfer color laser printer 10. Accordingly, printer 10 comprises a shuttle-type paper drive configured to achieve a four-pass color printing process in a relatively low cost manner and having accurate plane-to-plane registration between color image planes. Furthermore, such shuttle-type paper drive is compatible with a relatively wide range of media types, such as various thicknesses of sheet 64.

A micro controller (not shown) communicates with paper transport mechanism 28 to provide a feedback control system operative to precisely move sheet 64 along the direction of travel path 26 during a multiple stage printing operation.

Rollers 39 and 41 of each roller transport assembly 34–35 cooperate with grit belt transport assembly 36 to precisely guide a sheet 64 of paper laterally of paper travel path 26 in order to further ensure accurate registration between successive images that are printed onto sheet 64 using printer 10. Cylindrical roller 39 and cone roller 41 cooperate with an adjacent side wall of the printer to provide an edge guide paper path that guides a sheet of paper along a lateral edge.

Hence, rollers 39 and 41 cooperate with paper transport mechanism 28 and a micro controller to accurately move and present a sheet 64 of paper along paper travel path 26 while accurately transferring and superposing successive color image planes during a multiple color image transfer process.

Grit belt transport assembly 36 is controllably actuated in forward and reverse directions under control of control circuitry (not shown) of a microprocessor. Accordingly, control circuitry regulates positioning of sheet 64 along paper travel path 26 by regulating the drive signal for grit belt transport assembly 36 of paper transport mechanism 28. According to a color printing configuration, color laser printer 10 comprises at least three, and usually four, different color image planes. The alignment of these color image planes to one another is critical in order to achieve a resulting quality image on sheet 64.

Even slight variations between registration of different color image planes can result in hue and density shifts throughout the image that is printed on the sheet 64 of paper.

In operation, individual sheets of paper are retrieved from a pressure plate 44 of a paper tray 14 via a pick roller 46. A single sheet 64 of paper is then transferred between pick roller 46 and a transfer roller (not shown) and deposited at grit belt transport assembly 36, at a nip between a first pinch roller 66 and belt 38 which is directly supported against belt 38 via a co-rotating central pinch, or support, roller 72. Forward movement is imparted to the sheet by driving belt forward using a drive wheel 70.

Grit belt transport assembly 36 comprises drive wheel 70, follower wheel 77, central support rollers 72–73 and 75–76, and transfer roller 74, all provided inside of belt 38. Grit belt transport assembly 36 also comprises pinch rollers 66–69, provided outside of belt 38 and configured to coact in spring biased engagement with support rollers 72–73 and 75–76, respectively. Drive wheel 70 is driven with an electric motor (not shown) as known in the art.

Grit belt transport assembly 36 is actuated via drive wheel 70 so as to deliver a single sheet 64 of paper into position between a photoconductor drum (or roller) 50 and transfer roller 74 such that a first color image plane can be printed onto the sheet 64 of paper from drum 50. Accordingly, such sheet 64 of paper is presented between pinch rollers 66–67, 68–69 and belt 38 for movement along one edge of sheet 64 so as to shuttle sheet 64 bi–directionally along paper travel path 26.

According to one construction, drive wheel 70 and rollers 39 (journalled together with a common drive belt or, optionally, a gear train) are driven via a drive motor (not shown), under control of a micro controller. Grit belt 38 maintains accurate positioning of sheet 64 while shuttling sheet 64 along path 26, during transfer of multiple image planes to sheet 64 via a toner cartridge 25, 125, 225, or 325 of carousel 24.

Accordingly, grit belt transport assembly 36 accurately moves a sheet 64 of paper by trapping the sheet along one edge and between at least one pinch zone defined between rollers 66, 72; 67, 73; 68, 75; and 69, 76. The grit belt 38 serves to accurately grasp and locate a sheet 64 of paper between such rollers in order to ensure accurate registration during a multiple image plane printing operation. By replacing a traditional roller with grit belt 38, a sheet 64 of paper can pass all the way through the nip provided between photoconductor drum 50 and transfer roller 74, yet still maintain contact with at least two of the pinch zones provided along belt 38, at all times.

Figure 3:
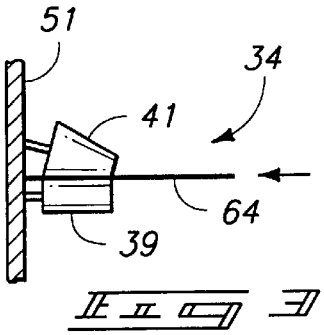
FIG. 3 is a partial sectional view taken along line 3—3 of FIG. 2 and showing the configuration of a cone roller transport assembly used to edge guide a sheet of paper by biasing the sheet against a side wall of the printer housing.

According to such implementation, process-wise registration of the sheet is maintained with grit belt 38, while cross-process registration is maintained using an edge guide paper path system provided by roller pairs 39 and 41 which cooperate to bias a page into a side wall 51 of printer 10 (see FIG. 3). Hence, accurate paper motion is maintained with grit belt 38, while allowing full access to top and bottom margins of sheet 64 when transferring image planes thereto, unlike typical standard laser printers. Accordingly, an edge guide grit belt paper drive enables minimum top and bottom margins in a shuttle type laser printer, while providing a low-cost, robust, and very precise means of paper transport.

According to one construction, high-resolution stepper motors are used to drive roller 39 and drive wheel 70. Alternatively, encoders can be provided on a drive motor to drive roller 39 and drive wheel 70.

As shown in FIG. 2, printer 10 comprises an electrophotographic color laser printer. Laser scanner 22 is provided within printer 10 for generating an optical image via an imaging path or a slot 60 which is superposed onto photoconductor drum 50 after drum 50 has been charged with a charge roller 56. Subsequently, one of four different colored toners is delivered from one of toner supply reservoirs 62, 162, 262 and 362.

According to the implementation depicted in FIG. 2, a rotating carousel 24 is employed containing a "black" toner supply reservoir 62 in a first cartridge 25, a "cyan" toner supply reservoir 162 in a second cartridge 125, a "magenta" toner supply reservoir 262 in a third cartridge 225, and a "yellow" toner supply reservoir 362 in a fourth cartridge 325. Hence, each of reservoirs 62, 162, 262, and 362 contains a powder toner having a respective associated color for use in generating one color image plane. Each respective cartridge 25, 125, 225, and 325 contains a respective photoconductor drum 50, 150, 250, and 350.

Printer 10 is preferably connected for control with a microprocessor-based computer (not shown) which submits print jobs to printer 10. Printer 10 includes an electrophotographic printer that is configured to print a color image onto sheet 64, in the form of an image plane (e.g., including text and/or graphics). As used here, the term "image" is intended to mean text, graphics, or both text and graphics. One or more superposed image planes cooperate to provide a final image on sheet 64.

As shown in FIG. 2, printer 10 comprises a color laser printer. In one embodiment, printer 10 includes internal components similar to those found in a LaserJet 4500 printer sold by Hewlett-Packard Company of Palo Alto, Calif.

Printer 10 includes housing 12 configured to support internal operating components. In the illustrated embodiment, printer 10 includes laser scanner 22 supported in housing 12. A toner supply is contained within one of toner supply reservoirs 62, 162, 262, and 362. Laser scanner 22 acts on photoconductor drum 50. A charge roller 55 is provided in contact with photoconductor drum 50 to impart charges to drums 50, 150, 250 and 350 upstream of where laser scanner 22 acts on such drums. A developer roller 57 is also provided in each of reservoirs 62, 162, 262, and 362 of cartridges 25, 125, 225, and 325, respectively, which acts on photoconductor drum 50 downstream from where the laser scanner 22 acts on photoconductor drum 50. Transfer roller 74 is provided at a location facing the photoconductor drum 50 downstream from developer roller 57 and cooperating with the photoconductor drum 50 to impart an image onto sheet 64.

A foam roller (or roll) 61 is also provided in each of reservoirs 62, 162, 262, and 362. Foam roller 61 provides a roll that rotates in counter-rotation against developer roller 57 to impart friction that creates a static charge on toner. The toner has a static charge that is repelled by the static charge placed on the drum by charge roller 55. The statically charged toner is then delivered from developer roller 57 onto uncharged locations present on drums 50, 1 50, 250, and 350. The uncharged locations result from action of laser scanner 22 along the imaging path of slot 60 to discharge selected locations on such drum which were previously charged by charge roller 55. Such discharged areas thereby receive charged toner particles which are delivered by developer roller 57.

A cleaning blade 54 is configured to clean photoconductor drum 50 within a waste toner reservoir 59 after the image has been imparted to sheet 64. Furthermore, a fuser assembly, or fuser, 86 is provided spaced apart from and downstream of the photoconductor drum 50 for fusing a transferred image onto sheet 64.

A drive motor (not shown) under computer control rotates carousel 24 to present a desired drum 50, 150, 250, or 350 from cartridge 25, 125, 225 or 325 into presentment against roller 74. Such rotation is controlled by a microcontroller. Additionally, a waste toner reservoir 59 is also provided in each cartridge 25, 125, 225, and 325 of carousel 24 for collecting waste toner that is removed by cleaner blade 54 from photoconductor drum 50, 1 50, 250, or 350, after depositing an image plane onto sheet 64 of paper.

In operation, carousel 24 is rotated to present one of drums 50 from cartridges 25, 125, 225, or 325 into presentment against roller 74. A color from such cartridge is then used to apply a first color onto a sheet of paper as it is shuttled between the drum and roller using the grit belt transport assembly of the present invention. Following transfer of such first color, carousel 24 is rotated 45 degrees so as to remove the presence of any drum from communicating with roller 74. Accordingly, a drum is moved to an intermediate position such that a gap is provided between roller 74 and carousel 24 when moving a sheet of paper via the grit belt transport assembly of Applicant's invention.

Following the transfer of a first color onto a sheet of paper via drum 50 and the shuttling or return of such paper to a rearward position within the printer, another drum 150 is rotated into position and engagement with roller 74 prior to delivering a second color onto such sheet of paper. Similar steps are carried out in shuttling the sheet of paper and transferring a third and fourth color onto such sheet prior to ejecting the sheet through fuser assembly 86 and either ejecting the single side printed sheet of paper through exit roller assembly 92, or inverting such paper through actuation of paper redirection guide, or sheet diverter gate, 90 for printing on a back side.

According to one construction, transfer roller 74 is supported at either end by a spring configured to engage transfer roller 74 with one of drums 50, 150, 250, or 350. Transfer roller 74 is further configured to be urged forward by such springs to a limited extent such that rotation of drums 50, 150, 250, or 350 to an intermediate position away from transfer roller 74 provides a gap between transfer roller 74 and an outer surface of carousel 24 to facilitate shuttling of a sheet of paper therebetween between subsequent color image transfer operations. Alternatively, or additionally, roller 74 can be moved into contact and away from contact with drums 50, 150, 250, and 350 using a solenoid (not shown) that is controlled by a microcontroller. However, it is understood that rotation of carousel 24 sufficient to move such drums to an intermediate position enables shuttling of the sheet of paper therebetween sufficiently without incorporating a solenoid to extend and retract roller 74.

Toner cartridges 25, 125, 225, and 325 of carousel 24 each further include an aperture, or slot, in which charge roller 55 is supported for contact with drum 50, and through which optical images are delivered via an imaging path of slot 60 onto charged photoconductor drum 50.

Preferably, toner cartridges 25, 125, 225 and 325 of carousel 24 are each designed as a replaceable toner/developer cartridge unit for a dedicated color, with color being accomplished by using multiple development stations as provided by reservoirs 62, 162, 262, and 362. One color is associated with each reservoir for the subtractive colors cyan, yellow and magenta, plus black. Typically, toners are colored with either a dye or a pigment. In operation, the four colored image planes are individually accumulated onto photoconductor drums 50, 150, 250, and 350, respectively, and transferred onto sheet 64 of paper, before transferring a successive color image plane. In this manner, according to the present embodiment, a sheet 64 of paper is passed between photoconductor drum 50 and transfer roller 74 up to four separate times.

It is understood that printer 10 works as any presently understood electrophotographic, or laser, printing process. More particularly, a charge roller comprises a conductive elastomer charge roller that is placed in direct contact with a photoconductor drum, such as drum 50. A charge roller generates a charge on the surface of photoconductor drum 50. Subsequently, laser scanner 22 traces the charged photoconductor drum 50 via the imaging path of slot 60 with a wavelength of exposing light source that matches the spectra sensitivity of photoconductor drum 50. The developed photoconductor drum 50 imparts monocomponent image development by receiving powder toner onto the charged surface of photoconductor drum 50, after which such toner is delivered onto sheet 64 when such sheet 64 is passed between transfer roller 74 and photoconductor drum 50. Accordingly, monocomponent development is well understood in the art, and is carried out up to four different times in order to deliver up to four different color planes onto a single sheet 64 of paper.

The novelty of Applicant's invention lies in the manner in which a single sheet 64 of paper is repeatedly delivered in an accurate positional manner across photoconductor drums 50, 150, 250, and 350 when delivering successive, superposed image planes thereon. One source of sheet 64 comes form paper tray 14. Another source of sheet 64 comes from an entrance feed slot 78, wherein a feed roller assembly 80 delivers a sheet 64 to grit belt transport assembly 36.

Although not shown in FIG. 2, it is understood that a plurality of guide tracks (not shown) are also provided within housing 12. Such guide tracks serve to direct sheet 64 within housing 12 as sheet 64 travels along paper travel path 26. Each guide track is formed from one or more rigid track walls, similar to those shown in U.S. Pat. No. 5,978,642, incorporated by reference.

A pair of paper redirection guides 82 and 83, each comprising a solenoid operated gate, are also provided within housing 12 to further selectively redirect sheet 64. More particularly, guide 82 is retracted via a solenoid to a lowered position to guide a sheet 64 between a pick roller 46 and a pinch roller 47 from tray 14 to travel path 26. Guide 82 is actuated to a mid-position to advance sheet 64 from slot 78 to travel path 26. Furthermore, guide 82 is advanced to a raised position to move sheet 64 into reverse guide track 29 when shuttling sheet 64 there along.

Similarly, guide 83 is movable to three positions. Guide 83 is movable to a completely extended position to guide a sheet of paper to cone roller transport assembly 35 when shuttling a sheet of paper between forward and reverse directions via grit belt transport assembly 36. Guide 83 is extended to a mid-position to advance sheet 64 into a fuser assembly 86 that delivers sheet 4 into another edge guide roller assembly 88. When it is desired to print on a single side of the sheet of paper, paper redirection guide 90 is raised to an elevated position to deliver the sheet of paper to exit roller assembly 92. However, when it is desirable to print on the back side of the sheet of paper, paper redirection guide 90 is pivoted to a lowered position, which redirects such paper so as to invert the paper, delivering the paper to edge guide roller assembly 84. Edge guide roller assembly 84 further delivers such paper along a downward delivery path back to travel path 26 for printing onto a back side of sheet 64.

More particularly, guide 83 is extended to a mid-position to deliver sheet 64 into a fuser assembly 86 for fusing of an image thereon. Roller assembly 88 then delivers sheet 64 to exit roller assembly 92, while paper redirection guide 90, comprising a solenoid operated gate, is retracted. Roller assembly 92 then delivers sheet 64 from printer 10. More particularly, once printing is complete, sheet 64 is delivered from housing 12 via exit rollers 92.

FIG. 3 illustrates in greater detail the construction of cone roller transport assembly 34 as seen in FIG. 2. It is understood that cone roller transport assembly 35 of FIG. 2 is similarly constructed.

More particularly, cone roller transport assembly 34 comprises cylindrical roller 39, which extends perpendicularly from side wall 51 of the printer. Cone roller 41 extends at an angle from side wall 51 so as to form a parallel contact surface with the cylindrical outer surface of roller 39.

According to one construction, cylindrical roller 39 is formed from an elastomer material, whereas cone roller 41 is formed from a hard plastic material. Cylindrical roller 39 is driven for rotation in forward and reverse directions using a servo motor and a continuous belt drive, or, alternatively, a gear train.

Due to the conical configuration of cone roller 41 cooperating with cylindrical roller 39, a sheet 64 of paper has been found to cooperate therebetween such that the sheet of paper is drawn against side wall 51 as the sheet is moved between rollers 39 and 41. Accordingly, an edge of sheet 64 is brought into alignment with side wall 51 while being moved back and forth between rollers 39 and 41. Accordingly, such sheet 64 is aligned against side wall 51 in a precise manner which ensures repeated registration of subsequent images onto sheet 64 during a multiple image printing operation.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A print media sheet feeder system, comprising:

a pair of edge guides including a pair of adjacent flanges cooperating to retain and guide one edge of a sheet of media therebetween;

an edge guide grit belt associated with the pair of edge guides to guide and move the sheet of media along a travel path of a peripheral device; and at least one pinch roller provided for co-rotation with the grit belt;

wherein the sheet of media is moved between the belt and the roller along one edge.

2. The print media sheet feeder system of claim 1 wherein the edge guide grit belt is provided along a lateral edge of a sheet of print media.

3. The print media sheet feeder system of claim 1 wherein the edge guide grit belt comprises a continuous belt having an outer surface coated with an abrasive grit material.

4. The print media sheet feeder system of claim 3 wherein the edge guide grit belt comprises a flat belt along an inner surface.

5. A print media sheet feeder system, comprising:

an edge guide grit belt;

a toothed belt along an inner surface to guide and move a sheet of media along a travel path of a peripheral device;

a complementary toothed drive wheel configured to engage and drive the edge guide grit belt; and at least one pinch roller provided for co-rotation with the grit belt;

wherein the sheet of media is moved between the belt and the roller along one edge.

6. A print media sheet feeder system, comprising;

edge guide grit belt is operative to guide and move a sheet of media bidirectionally along a travel path of a peripheral device; and at least one pinch roller provided for co-rotation with the grit belt;

wherein the sheet of media is moved between the belt and the roller along one edge.

7. The print media sheet feeder system of claim 6 wherein the edge guide grit belt moves the sheet of media between a forward guide track and a reverse guide track.

8. A print media sheet feeder system, comprising:

an edge guide grit belt to guide and move a sheet of media along a travel path of a peripheral device;

at least one pinch roller provided for co-rotation with the grit belt; and a sheet diverter gate downstream of a fuser and operative to redirect the sheet into the travel path upside down and in an opposite direction so as to provide duplex image transfer onto the sheet;

wherein the sheet of media is moved between the belt and the roller along one edge.

9. A print media sheet feeder system, comprising:

an edge guide grit belt associated with the pair of edge guides to guide and move the sheet of media along a travel path of a peripheral device;

at least one pinch roller provided for co-rotation with the grit belt; and a plurality of pinch rollers cooperating with the grit belt to transport the sheet of print media by accurately guiding the sheet of print media along a lateral edge for transport along the travel path;

wherein the sheet of media is moved between the belt and the roller along one edge.

10. A print media sheet feeder system, comprising:

an edge guide grit belt including a drive wheel, a follower wheat and a plurality of intermediate support rollers about which the belt is driven in rotation; and a plurality of pinch rollers provided for co-rotation with the grit belt, each pinch roller opposite one of the intermediate support rollers such that a sheet of media is driven by the belt, between at least one of the pinch rollers and the corresponding intermediate support roller;

wherein the sheet of media is moved between the belt and the roller along one edge.

11. A printing system for printing at least one image plane onto a sheet of print media, comprising:

an electrophotographic print engine including a photoconductor drum and a transfer roller configured to interact in co-rotation with the drum during transfer of an image plane from the drum onto a sheet of print media passed therebetween; and a print media sheet feeder system including an edge guide grit belt to a guide and move a lateral edge of a sheet of media along a travel path of the printing system and a pinch roller provided for co-rotation with the belt;

wherein the edge guide grit belt and the pinch roller cooperate to move the sheet of media along the travel path.

12. The printing system of claim 11 wherein the belt is tensioned for movement about a drive wheel and a follower wheel.

13. The printing system of claim 12 further comprising a drive motor communicating with the drive wheel and operative to drive the belt.

14. The printing system of claim 11 wherein the belt is bidirectional, and further comprising a sheet diverter gate downstream of a fuser and operative to redirect the sheet into the travel path upside down and in an opposite direction so as to provide duplex image transfer.

15. The printing system of claim 11 wherein the edge guide grit belt comprises a drive wheel, a follower wheel and a plurality of intermediate guide wheels about which the belt is driven in rotation, and wherein a pair of pinch rollers are provided opposite each intermediate guide wheel such that a sheet of media is driven by the belt, between at least one of the pinch rollers and a corresponding one of the intermediate guide wheels.

16. A laser printer media drive system, comprising:

a drive motor;

a drive wheel driven by the drive motor;

a follower wheel disposed from the drive wheel;

a grit belt tensioned about the drive wheel and the follower wheel;

a pinch roller biased into engagement with the grit belt for co-rotation with the grit belt as a sheet of media is received therebetween;

wherein the drive motor and the drive wheel cooperate to move the grit belt along a lateral edge of a sheet of media to move the sheet along a travel path during a print operation.

17. The media drive system of claim 16 further comprising a support roller provided within the grit belt between the drive wheel and the follower wheel and configured to coact with the pinch roller.

18. The media drive system of claim 17 further comprising a second support roller provided within the grit belt and spaced from the first support roller and a transfer roller provided between the first support roller and the second support roller.

19. The media drive system of claim 17 wherein a first pinch roller is engaged for co-rotation with the first support roller, and a second pinch roller is engaged for co-rotation with the second support roller, and wherein the grit belt is received between the first and second support rollers and pinch rollers so as to provide a first pinch zone and a second pinch zone on opposite sides of the transfer roller.

20. The media drive system of claim 16 wherein the grit belt maintains process-wise registration of a sheet of paper along a paper travel path, and wherein cross-process registration is maintained using an edge guide paper path comprising at least one cone roller.

* * * * *

UNITED STATES PATENT AND TRADEMARK OFFICE

CERTIFICATE OF CORRECTION

PATENT NO. : 6,385,431 B1
DATED : May 7, 2002
INVENTOR(S) : Arcaro et al.

It is certified that error appears in the above-identified patent and that said Letters Patent is hereby corrected as shown below:

Column 3,
Line 23, “comprises in” should read -- comprises an --;
Line 26, “interface 16” should read -- interface 18 --;

Column 8,
Line 48, “form paper” should read -- from paper --;

Column 10,
Line 30, “belt is operative” should read -- belt operative --;
Line 66, “wheat” should read -- wheel --;

Column 11,
Line 17, “to a guide” should read -- to guide --.

Signed and Sealed this

Twenty-seventh Day of July, 2004

JON W. DUDAS
*Acting Director of the United States Patent and Trademark Office*